US006449788B1

(12) United States Patent
Nichols

(10) Patent No.: US 6,449,788 B1
(45) Date of Patent: Sep. 17, 2002

(54) PILLOW WITH MALLEABLE CORE

(76) Inventor: Mary L. Nichols, P.O. Box 598, 910 Rose St., South Pekin, IL (US) 61564

( * ) Notice: Subject to any disclaimer, the term of this patent is extended or adjusted under 35 U.S.C. 154(b) by 0 days.

(21) Appl. No.: 09/985,191

(22) Filed: Nov. 1, 2001

(51) Int. Cl.[7] ..... A47G 9/00
(52) U.S. Cl. ..... 5/636; 5/630
(58) Field of Search ..... 5/636, 655, 639, 5/640, 643, 644, 646, 648, 630, 632

(56) References Cited

U.S. PATENT DOCUMENTS

| | | | | | |
|---|---|---|---|---|---|
| 2,013,481 | A | | 9/1935 | Stonehill | |
| 3,719,185 | A | * | 3/1973 | Hanes | 5/630 |
| 3,899,797 | A | | 8/1975 | Gunst | |
| 4,916,765 | A | * | 4/1990 | Castronovo, Jr. | 5/636 |
| 5,018,231 | A | * | 5/1991 | Wang | 5/636 |
| 5,033,137 | A | * | 7/1991 | Pedrow | 5/636 |
| 5,544,377 | A | | 8/1996 | Gostine | |
| 5,638,564 | A | * | 6/1997 | Gerrnawalt et al. | 5/636 |
| 5,682,633 | A | * | 11/1997 | Davis | 5/636 |
| 5,732,427 | A | | 3/1998 | Parnham | |
| 5,819,743 | A | * | 10/1998 | McMillin et al. | 5/646 |
| 6,088,854 | A | | 7/2000 | Brownrigg | |

FOREIGN PATENT DOCUMENTS

| | | | | |
|---|---|---|---|---|
| DE | 4237792 A1 | * | 5/1993 | 5/655 |

* cited by examiner

*Primary Examiner*—Alexander Grosz
(74) *Attorney, Agent, or Firm*—Patent & Trademark Services; Joseph H. McGlynn

(57) ABSTRACT

A therapeutic pillow having a malleable core and at least one layer of foam surrounding the malleable core. The malleable core allows the therapeutic pillow to retain the bent shape as needed by a user. If the therapeutic pillow has more than one layers of foam and the layers of foam may be of different firmness allowing the user to have increased comfort.

3 Claims, 1 Drawing Sheet

PILLOW WITH MALLEABLE CORE

BACKGROUND OF THE INVENTION

This invention relates, in general, to a pillow, and, in particular, to an improved, pillow, or the like, having a malleable core.

DESCRIPTION OF THE PRIOR ART

In the prior art various types of have been proposed. For example, U.S. Patent No. U.S. Pat. No. 6,088,854 to Brownrigg discloses a pillow having a malleable core.

U.S. Pat. No. 5,732,427 to Parnham discloses a pillow having a removable core.

U.S. Pat. No. 2,013,481 to Stonehill discloses a pillow divided into two connected halves.

U.S. Pat. No. 3,899,797 to Gunst discloses an inflatable pillow.

U.S. Pat. No. 5,544,377 to Gostine discloses a therapeutic pillow having a center section and two spherical ends.

SUMMARY OF THE INVENTION

The present invention is directed to a pillow that has a malleable core surrounded by at least one layer of foam. The malleable core allows the pillow to be bent and to retain the shape desired by the user.

It is an object of the present invention to provide a new and improved pillow.

It is an object of the present invention to provide a new and improved pillow with a malleable core.

It is an object of the present invention to provide a new and improved pillow with a malleable core with at least one layer of foam.

It is an object of the present invention to provide a new and improved pillow with a malleable core having a therapeutic foam outer layer.

It is an object of the present invention to provide a new and improved pillow having a malleable core wherein the pillow has a removable cover.

These and other object s and advantages of the present invention will be fully apparent from the following description, when taken in connection with the annexed drawings.

DESCRIPTION OF THE PREFERRED EMBODIMENT

At the present time, care-givers utilize conventional pillows in order to comfort quadriplegics and other bed-ridden patients safely and comfortably in bed. Care-givers utilize these pillows to position the patient's head and/or limbs in the proper position for maximum comfort. It is essential that the pillows used for quadriplegics and other bed-ridden patients are both the proper size and positioned well in order to reduce, or prevent, bedsores and to provide comfort. However, conventional pillows compress easily and, therefore, do not provide adequate support. Additionally, conventional pillows do not retain their shape since a conventional pillow compresses easily.

Figure 1:
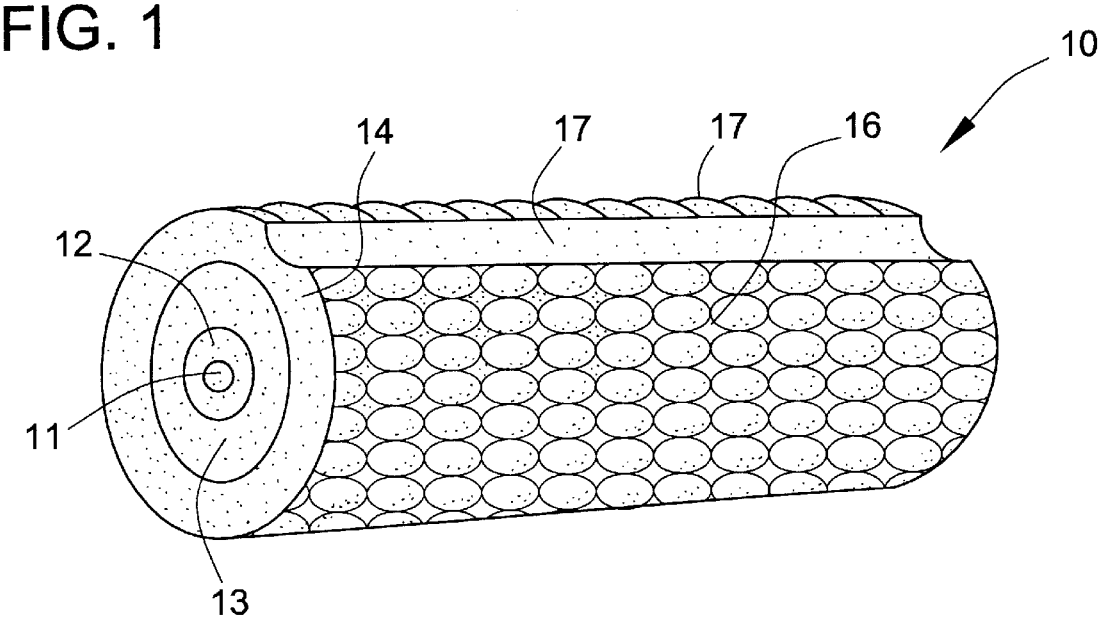
FIG. 1 is a perspective view of the present invention without its covering.
Figure 2:
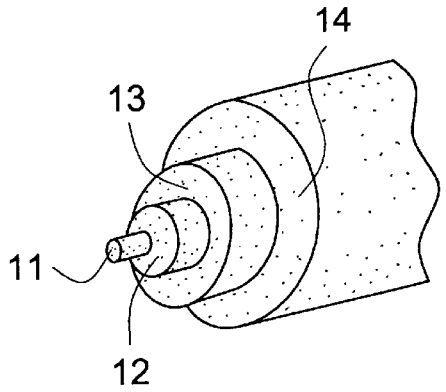
FIG. 2 is a partial view of the end of the present invention.
Figure 3:
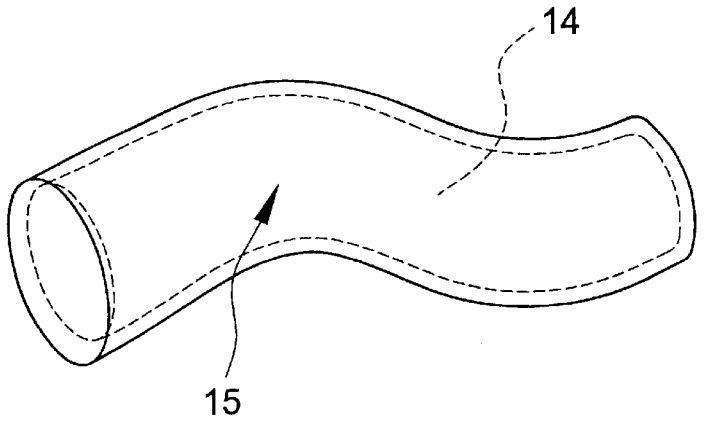
FIG. 3 is a view of the present invention with a covering and after the invention has been bent into a different shape.

Referring now to the drawings in greater detail, FIG. 1 shows a perspective view of the present invention 10. The present invention 10 has a malleable core 11 made from a material that will retain its shape after being bent. This allows the present invention to take a semi-permanent form when adjusted as shown in FIG. 3. The pillow 10 also has at least one layer of foam 12 surrounding the malleable core 11, although the preferred form of the invention has two additional layers of foam 13, 14 which surround the first layer of foam 12. It should be noted the present invention 10, as shown in FIG. 1, is merely for illustration purposes and should not be considered the only shape (i.e. cylindrical) in which the present invention 10 could be produced. For example, the present invention 10 may be in the form of a rectangle or in a non-uniform shape, instead of the cylindrical shape as shown in FIG. 1.

In another embodiment, the present invention 10 could be constructed of several pieces allowing for different shapes, instead of one piece. These different variations of the present invention 10 could be used to elevate a patient's legs, shoulder or neck, or other parts of the body.

While the term "foam" has been used to describe the present invention, the present invention should not be limited to "foam" since other materials, either natural or synthetic, may be used without departing from the scope of the invention.

In order to the patient problems, mentioned above, the present invention 10 is designed to have a malleable core 11 so that the present invention 10 will retain its shape in a semi-permanent manner. The malleable core 11 allows the user to bend the present invention 10 into a position to provide better support and comfort, as compared to a conventional pillow which will not easily maintain different shapes. In addition to the malleable core 11, the present invention features at least one layer of foam 12 surrounding the malleable core 11.

If the present invention 10 incorporates additional layers of foam (i.e. 13, 14), the firmness of the foam can vary. For example, the first layer of foam 12 surrounding the malleable core 11 may be firm. The second layer of foam 13 surrounding the first layer of foam 12 may be less firm, and the layer 14 can be even firmer than layer 13. The last layer of foam 14 can have therapeutic bubbles or projections 16 placed around the outer surface of the layer 14 to provide greater comfort to the patient. Also, it should be noted that the relative firmness of the various layers 12, 13, 14 can be arranged in any order desirable for the comfort of the patient. For example, the layer 13 could be less or more firm than the layer 12, and the layer 14 could be less or more firm than the layers 12, 13.

The malleable core 11 may be constructed from a plastic, metal, or any material known within the art to be both malleable and able to retain its shape when bent by a user.

In addition, the present invention 10 features a washable, removable cover 15 in FIG. 3 made from materials, either natural or synthetic, known within the art. The cover may fit either snugly or loosely over the present invention 10 and serves a similar purpose as a conventional pillowcase and will be available in an assortment of colors and patterns.

The therapeutic foam outer layer 14 may have a shallow concave trough 17 (see FIG. 1) that provide additional support for the patient. for example a patient's arm can be placed in the trough 17 in order to provide firm support for the arm.

Although the Pillow and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A pillow comprising:

an elongated element having an outer surface and ends, said surface connecting said ends, said elongated element having a central cavity between said ends, said cavity containing an elongated, malleable core to be bent and to retain the shape it is bent into, said pillow having at least two layers of material of different firmness interposed between said elongated core and said outer surface, said outer surface comprising a plurality of projections disposed thereon and further comprising a trough extending along at least a portion thereof, between send ends.

2. The pillow as claimed in claim 1, wherein a removable cover covers said elongated element.

3. The pillow as claimed in claim 1, wherein said elongated element is substantially cylindrical in shape.

* * * * *